US005336557A

United States Patent [19]

Takamatsu et al.

[11] Patent Number: 5,336,557

[45] Date of Patent: Aug. 9, 1994

[54] CARBON FIBER FELTING MATERIAL AND PROCESS FOR PRODUCING THE SAME

[75] Inventors: Akio Takamatsu; Yoshiyuki Nishimura, both of Kamisu, Japan

[73] Assignee: Petoca Ltd., Tokyo, Japan

[21] Appl. No.: 748,726

[22] Filed: Aug. 22, 1991

[30] Foreign Application Priority Data

Aug. 23, 1990 [JP] Japan ..... 2-220061

[51] Int. Cl.[5] ..... B32B 5/06; B32B 11/10; B32B 31/16; B32B 31/26; D01F 9/145

[52] U.S. Cl. ..... 428/300; 52/782; 156/62.4; 156/62.8; 156/148; 156/300; 423/447.1; 423/447.2; 428/367; 428/408; 428/920

[58] Field of Search ..... 428/367, 408, 920, 300; 156/62.4, 62.8, 148, 300; 423/447.1, 447.2

[56] References Cited

U.S. PATENT DOCUMENTS

| | | | |
|---|---|---|---|
| 4,014,725 | 3/1977 | Schulz | 156/148 |
| 4,350,672 | 9/1982 | Layden, Jr. et al. | 423/445 |
| 4,628,001 | 12/1986 | Sasaki et al. | 428/367 |
| 4,776,994 | 10/1988 | Nelson et al. | 264/29.2 |
| 4,849,200 | 7/1989 | Uemura et al. | 423/447.4 |
| 4,868,037 | 9/1989 | McCullough et al. | 428/367 |
| 4,898,783 | 2/1990 | McCullough et al. | 428/408 |
| 4,977,023 | 12/1990 | Krupp et al. | 428/408 |
| 5,034,267 | 7/1991 | McCullough et al. | 428/408 |
| 5,035,942 | 7/1991 | Nagata et al. | 428/408 |
| 5,047,292 | 9/1991 | Salanobu et al. | 428/367 |
| 5,057,341 | 10/1991 | Ogiso et al. | 428/408 |
| 5,068,061 | 11/1991 | Knobel et al. | 428/408 |

FOREIGN PATENT DOCUMENTS 0386633 9/1990 European Pat. Off. .

*Primary Examiner*—James C. Cannon
*Attorney, Agent, or Firm*—Armstrong, Westerman Hattori, McLeland & Naughton

[57] ABSTRACT

The disclosed carbon fiber felting material has a bulk density of 0.01 to 0.5 g/cm$^3$ and a thermal conductivity of at most 1.0 kcal/m·hr·°C. in the thickness-wise direction thereof at 2,200° C. The carbon fiber felting material is formed through physical and/or chemical interfiber entanglement. The carbon fiber felting material is very stable in an inert atmosphere, and excellent in heat insulating properties in a high-temperature range and against radiant heat transfer in particular.

3 Claims, No Drawings

CARBON FIBER FELTING MATERIAL AND PROCESS FOR PRODUCING THE SAME

BACKGROUND OF THE INVENTION

1. Field of the Invention

The present invention relates to a heat-insulating, carbon fiber felting material excellent in heat insulating properties, particularly in a high temperature range.

More particularly, the present invention relates to a carbon fiber felting material which exhibits excellent heat resistance and morphological stability within the temperature range of 500° to 2,800° C. as well as excellent heat insulating properties against radiant heat transfer in particular.

Still more particularly, the present invention relates to a carbon fiber felting material so excellent in heat insulating properties within the high temperature range that the felting material can be used for heat insulation of high temperature furnaces and the like which are used in fusion of glass, firing of pottery, smelting of metals, sintering of ceramics, or heat treatment of carbonaceous materials.

The present invention further relates to a carbon fiber felting material so excellent in stability against thermal radiation that the felting material can be used as a heat insulating material with excellent performance in nuclear furnaces and nuclear power generating installations.

2. Related Art

Porous ceramic materials have heretofore been mostly used as heat insulating materials serviceable within a high temperature range. These heat-insulating ceramic materials have an excellent high-temperature stability. In order to lower the thermal conductivity, however, they are required to have a considerable porosity.

The pores of the porous ceramic materials are not of completely closed-cell type, but usually is considerably restrictive on gaseous flow therethrough. This is so, from the viewpoint of strength, because those pores are formed in such a way as to communicate with the outsides of the porous ceramic materials only through considerably small passages. This will be understandable if consideration is given to the fact that any shaped ceramic article is decreased in strength in the case where it includes so large defects around the peripheries of its pores as to allow a gas to easily flow therethrough.

Because of such morphological characteristics, the conventional heat-insulating ceramic materials are generally so weak against rapid cooling as well as rapid heating that they may involve a problem of frequent structural collapse beginning with the surfaces thereof upon changes of the temperature, which is called "spalling." In order to provide a heat-insulating ceramic material hardly subject to spalling, it is generally necessary to select a ceramic material low in porosity and hence poor in heat insulating properties, which must, therefore, be used in large amount.

As a solution to the foregoing problems, fibrous ceramic materials have heretofore been widely used as heat insulating materials. The fibrous ceramic materials exhibit an excellent heat insulating effect. However, they are generally expensive due to a difficulty encountered in production thereof. This is one reason for the high price of a high-temperature furnace.

On the other hand, the predominant mode of heat transfer shifts to radiant heat transfer with relatively decreasing contribution of convective as well as conductive heat transfer when the temperature reaches the high-temperature range of at least 500° C. This presents a problem that, when the performance of a heat insulating material is considered in association with an aspect of its heat insulation mechanism, the heat insulating material effective in the low-temperature range of at most 200° C. does not necessarily exhibit good performance in the high-temperature range.

Particularly, heat-insulating fibrous ceramic materials exhibit an excellent heat insulating effect in the low-temperature region, but are so poor in capability of radiation absorption and scattering as to provide an insufficient heat insulating effect against radiant heat transfer in the high-temperature range, because of their generally high transparency and very high surface smoothness characteristic of such fibers.

On the other hand, either carbonaceous or graphitic materials, e.g., mesophase pitch type materials in particular have heretofore attracted attention of little significance as heat insulating materials because they are generally high in thermal conductivity to allow for large conductive heat transfer therethrough.

Since these materials are high in absorbance for radiations ranging from ultraviolet radiation to infrared radiation within a wide wave range and endowed with high morphological stability at high temperatures, however, it has been believed that they could probably be used as heat insulating materials if they were provided with a morphology highly capable of radiation scattering.

An object of the present invention is to provide a heat insulating material which can solve not only the problem that the conventional heat insulating materials for use in the high-temperature range are weak against rapid temperature changes and generally insufficient in the heat insulating effect against radiant heat transfer, but also the problem that the heat-insulating, fibrous ceramic materials are generally expensive and insufficient in the heat insulating effect against radiant heat transfer.

SUMMARY OF THE INVENTION

As a result of extensive investigations with a view to solving the above-mentioned problems, the authors of the present invention have found out that a felting material produced through such entanglement of a thin carbon fiber material as to take the form of a high bulk density felt is very useful as a heat insulating material in the high-temperature range since it is very low in thermal conductivity especially in the thickness-wise direction of the felt. The present invention has been completed based on this finding.

More specifically, in accordance with one aspect of the present invention, there is provided a carbon fiber felting material excellent in heat insulating properties in the high-temperature range: which is substantially in the form of a felt formed through interfiber entanglement and having a bulk density of 0.01 to 0.5 g/cm$^3$ and a thermal conductivity of at most 1.0 kcal/m·hr·°C. in the thickness-wise direction thereof at a temperature of 2,200° C.

The carbon fiber used in the carbon fiber felting material of the present invention preferably has an average filament diameter of 1 to 9 $\mu$m.

The carbon fiber is preferably of a pitch type, more preferably of a mesophase pitch type having a moisture absorption of at most 2 wt. % in an atmosphere having a temperature of 20° C. and a relative humidity of 65%.

In accordance with another aspect of the present invention, there is provided a process for producing a carbon fiber felting material excellent in heat insulating properties: comprising the step (1) of spinning a starting pitch material by a melt blow method and collecting the spun fiber into the form of a sheet, the step (2) of subjecting the fiber sheet to infusiblization and subsequent slight carbonization treatments, and the step (3) of piling up a desired number of the resultant carbon fiber sheets and subsequently entangling the carbon fiber sheets with each other, followed by carbonization of the resultant mat if desired.

DETAILED DESCRIPTION

The present invention will now be described in more detail.

CARBON FIBER

A carbon fiber preferably having an average filament diameter of 1 to 9 μm is used in the carbon fiber felting material of the present invention.

Additionally stated, the average filament diameter of the carbon fiber subjected to the slight carbonization treatment but before being subjected to the entanglement treatment such as needle punching is slightly larger (by about 10%) than the average filament diameter of the final carbon fiber heat-treated at a high temperature.

The average filament diameter is expressed by an average value of the diameters of, for example, 100 randomly sampled filaments which are measured through an optical microscope or an electron microscope.

The thermal conductivity of a heat-insulating material as used in the high-temperature range, in the thickness-wise direction thereof at a temperature of 2,200° C., is desired to be at most 1.0 kcal/m·hr·°C., preferably at most 0.7 kcal/m·hr·°C. When the average filament diameter exceeds 9 μm, a difficulty is encountered in holding down the thermal conductivity, as mentioned above, of the carbon fiber felting material at or below 1.0 kcal/m·hr·°C. When the average filament diameter is smaller than 1 μm, various troubles, including incorporation of odd-shaped particles other than fibrous materials and breakage of filaments, are unfavorably liable to occur in the step of fiber spinning from pitch in particular.

The use of the carbon fiber having a small filament diameter as the fiber to constitute the felting material greatly enhances the heat insulating effect against radiant heat transfer.

When consideration is given, for example, to spinnability into such a morphology as to provide a high heat insulating effect, the carbon fiber is preferably of a pitch type, such as a petroleum pitch type or a coal pitch type, especially preferably of a mesophase pitch type. In addition, however, carbon fibers respectively produced from polyacrylonitrile, rayon, and novolak resin as the starting materials can be used in the present invention.

The moisture absorption of the carbon fiber is desired to be as low as possible. The moisture absorption particularly in an atmosphere having a temperature of 20° C. and a relative humidity of 65% is preferably at most 2%, more preferably at most 0.1%.

Among various pitch type carbon fibers, a mesophase pitch type carbon fiber is comparatively low in moisture absorption and hence provides favorable properties for the carbon fiber felting material of the present invention produced therefrom.

The above-mentioned value of moisture absorption is a proportion of the weight of absorbed water relative to the weight of the felting material.

When a carbon fiber felting material having a high moisture absorption is used as a heat insulating material, evaporation of absorbed moisture occurs during the course of heat-up thereof from room temperature to unfavorably lower the heat insulating effect of the heat insulating material. In addition, such a carbon fiber felting material gives out steam into the atmosphere surrounding the carbon fiber to cause deterioration of the carbon fiber at high temperatures.

ENTANGLEMENT

The carbon fiber felting material of the present invention substantially keeps the morphology thereof thanks to the interfiber entanglement thereof.

The term "entanglement" used herein is not restricted to "physical entanglement" in a narrow sense, but is intended to encompass any chemical and/or physical interfiber entanglement in so far as a carbon fiber aggregate randomly gathered in a spread state can be formed thereby into a felty material.

(A) Physical Entanglement

General physical entanglement treatments employable in the present invention include entanglement with turbulent gaseous flow, entanglement with penetrating columnar liquid flow, and entanglement by needle punching, etc. Interfiber entanglement by needle punching is preferable from the viewpoint of avoiding putting fiber orientation in the thickness-wise direction of the felting material into disarray.

(B) Entanglement with Binder

Interfiber application of a binder is effective as chemical entanglement to keep the carbon fiber in the form of a felting material. Such binder application may be employed either alone or in combination with physical entanglement as mentioned above.

The binder is desirably of such a type as to turn into a non-fibrous carbonized product through the carbonization treatment for the production of the heat-insulating, carbon fiber felting material according to the present invention. Specific examples of the binder include those including at least one member selected from among phenolic resins, furan resins, amino resins, tar, and pitch.

The use of the binder such as the above-mentioned specific resin or tar permits the felting material according to the present invention to take a considerably complicated shape because mat-like or felty carbon fiber materials may be not only simply piled up but also further formed into such a complicated shape through interfiber adhesion with the binder such as the resin or tar at the middle stage of entanglement.

(C) Binderless Entanglement

According to the present invention, without use of the above-mentioned binder, a pitch fiber prior to carbonization (precursor fiber) can be self-bonded at the time of carbonization to keep the morphology thereof felty. In this case, physical entanglement such as needle punching may be combined with such self-bonding.

In the foregoing pitch fiber self-bonding method, the infusiblization treatment is effected under such weak conditions as not to bring about complete infusiblization of the fiber while keeping the fiber morphology in a stable state.

In order to enhance the self-bonding properties of the pitch fiber, a precursor fiber which is readily infusiblized may be blended with a precursor fiber which is not readily infusiblized, provided that at least one of the precursor fibers is a pitch fiber. According to this method, the morphology-retaining properties of the fiber easy of infusiblization can be fully utilized, while at the same time adhesion of the fiber not easy of infusiblization can be utilized.

Examples of the precursor fiber readily infusiblized include those derived from polyacrylonitrile, cellulose, a phenolic resin, or optically anisotropic pitch. Examples of the precursor fiber not easy of infusiblization include those derived from optically isotropic pitch, polyvinyl alcohol, or aramids.

The precursor fiber not readily infusiblized sometimes cannot keep the morphology at the time of carbonization. This problem can be solved when use is made of a blended yarn produced by bicomponent spinning of the precursor fiber not readily infusiblized and the precursor fiber readily infusiblized.

HEAT-INSULATING CARBON FIBER FELTING MATERIAL

The carbon fiber felting material of the present invention, which is characterized by interfiber entanglement as described hereinbefore, has a bulk density of 0.01 to 0 5 g/cm$^3$, preferably 0.05 to 0.5 g/cm$^3$, and a thermal conductivity of at most 1.0 kcal/m·hr·°C., preferably at most 0.7 kcal/m hr °C., as measured in the thickness-wise direction of the felting material at 2,200° C.

The bulk density of the felting material of the present invention is 0 01 to 0 5 g/cm$^3$, preferably 0.05 to 0.5 g/cm$^3$, because the porosity of the felting material is desired to be increased as use as possible by making much of any gas included therein in order to enhance the heat insulating effect thereof.

The heat insulating effect of the felting material is enhanced as the bulk density of the felting material is increased, in so far as the carbon fiber in the felting material is not oriented in a continuous state in the direction of the Z axis.

When the bulk density is lower than 0.01 g/cm$^3$, the radiation-scattering effect of the felting material may be lowered to increase the thermal conductivity thereof. When the bulk density is so high as to exceed 0.5 g/cm$^3$, the thermal conductivity is increased as well to lower the heat insulating effect of the felting material.

The bulk density of the felting material can be adjusted to a predetermined level by controlling the needle punching density during entanglement, the pressure applied thereto during carbonization, and/or equivalent processes known in the art.

In the case where a binder to be converted into a non-fibrous carbonized product is in a state of being applied on the felting material of the present invention, the carbon fiber content of the felting material is preferably in the range of about 60 to 95 wt. %, more preferably about 70 to about 90 wt. %. Conversely speaking, the content of the binder matrix convertible into the non-fibrous carbonized product in the felting material is preferably in the range of about 5 to about 40 wt. %, more preferably about 10 to about 30 wt. %.

In other words, it is not preferable from the viewpoint of the heat insulating properties of the felting material that either the carbon fiber or the binder matrix be continuous in the thickness-wise direction of the felting material (in the direction of Z axis in which heat insulation is desired). In this respect, it is believed that either the carbon fiber or the binder matrix is preferably oriented only in parallel with the X-Y plane of the felting material.

In general, the binder matrix is used to keep the desired shape of felting material resistant to processing and the like. Point-wise interfiber adhesion is generally preferable, while the amount of the binder matrix itself is preferably as small as possible. In order to keep the desired shape of felting material, however, it is necessary to use some amount of the binder matrix. In this sense, the binder matrix content of the felting material is usually about 5 to 40 wt. %.

The term "carbon fiber content" as well as "binder matrix content" used herein is intended to indicate a value calculated based on the yield of carbon or graphite formed by individual heat treatment of a fiber as well as a binder.

The method of measuring the thermal conductivity of carbon fiber felting material as specified in the present invention is in accordance with JIS A 1412 "Procedure of Measuring Thermal Conductivity of Heat Insulating Material" except for use of a radiation pyrometer instead of a thermocouple as specified in JIS for the measurement of temperature, the use of which is difficult in this case.

The carbon fiber felting material of the present invention has a thermal conductivity of at most 1.0 kcal/m·hr·°C., preferably at most 0.7 kcal/m·hr·°C. as measured in the thickness-wise direction of the felting material at a temperature of 2,200° C.

As described hereinabove, the carbon fiber felting material of the present invention is of technological significance in that it is (a) constituted of a thin carbon fiber having an average filament diameter of, for example, 1 to 9 μm and (b) subjected to such interfiber entanglement as to have a high bulk density of 0.01 to 0.5 g/cm$^3$, preferably 0.05 to 0.5 g/cm$^3$, with the result that it (c) can exhibit a very high heat insulating effect as demonstrated above in terms of thermal conductivity, and especially an excellent heat insulation performance against radiant heat transfer, and that it (d) is useful as a heat-insulating material at high temperatures since the carbon fiber is a material that can be used stably in an inert atmosphere up to about 2,800° C.

PRODUCTION OF CARBON FIBER FELTING MATERIAL

In brief, the carbon fiber felting material of the present invention is preferably produced through the step (1) of spinning a starting pitch material by a melt blow method and collecting the spun fiber into the form of a sheet, the step (2) of subjecting the fiber sheet to infusiblization and subsequent slight carbonization treatments, and the step (3) of piling up a desired number of the resultant carbon fiber sheets and subsequently entangling the carbon fiber sheets with each other, followed by carbonization of the resultant mat if desired.

Entanglement

Specifically, entanglement may be effected through [a] a physical entanglement treatment such as needle punching at a density of 2 to 100 punches/cm$^2$ and/or

[b] a chemical entanglement treatment comprising impregnation of the carbon fiber mats with at least one substance selected from among phenolic resins, furan resins, amino resins, tar and pitch, subsequent curing of a resin if used, and carbonization of the impregnating substance into a non-fibrous carbonized product, or [c] a chemical entanglement treatment comprising infusiblization of pitch fiber sheets obtained in the step (1) under such conditions as to bring about interfiber self-bonding thereof at the time of carbonization, and piling-up and subsequent carbonization of a desired number of infusiblized pitch fiber sheets.

The process for producing a carbon fiber felting material according to the present invention will now be described in detail.

Step (1)

[1] Production of Pitch Fiber

The spinning step of producing a pitch fiber (precursor fiber) may employ an arbitrary spinning method such as a centrifugal spinning method, a spun-bonding method, and a melt blow method, which is especially preferable because thin filaments can be relatively easily produced thereby.

As the filaments are thinner, the curvature radius of the filaments are naturally smaller to show a tendency to have a higher capability of radiation scattering on the surfaces thereof, which is believed to greatly contribute to heat insulation against radiant heat transfer.

Furthermore, thinner filaments are known to contribute to heat insulation against convectional heat transfer. In view of the foregoing, a carbon fiber produced through melt blow spinning is believed to be excellent in heat insulating properties in the high-temperature range.

Among pitch fibers employable in the present invention, a pitch fiber produced through melt blow spinning is especially excellent as a material for forming a heat-insulating felting material.

The reason is that such a pitch fiber is generally not linear but curled or crimped. Non-linear parts of the fiber provide room for permitting fiber movement during needle punching to lower the probability of fiber breakage and increase the proportion of fibers inclined relative to the surfaces of the resulting sheet at the sites of interfiber entanglement. This results in a reduction of through-fiber conductive heat transfer, leading to an advantage of unhindered heat-insulating effect.

The use of a mesophase pitch type carbon fiber in particular provides a low-moisture-absorption carbon fiber felting material.

Specifically, in the case of melt blow spinning, spinning may usually be done through spinning orifices provided in a nozzle or a slit, which ejects a gas at a high speed, under spinning conditions involving a spinneret temperature of 290° to 360° C., a gas temperature of 310° to 380° C., and a gas ejection rate of 100 to 340 m/sec.

[2] Collection of Spun Fiber into the Form of Sheet

In the process of the present invention, the spun fiber is preferably collected into the form of a sheet in a step directly associated with the spinning step to produce a mat-like material. This is advantageous in that no fibrous material is contained in the final product because the opening and/or carding step liable to give damage to a fiber having a small elongation can be dispensed with unlike in conventional processes for producing a non-woven fabric.

The fiberous material presents a problem of contaminating the surroundings or clogging the filter(s) of an air conditioner during the service of a heat insulating material because of its high mobility.

The method of collecting a spun fiber into the form of a sheet in a step directly associated with the spinning step is advantageous in that sheets can generally be produced in low cost.

[3] Production of Mat-like Material

In the process of the present invention, if necessary, the pitch fiber sheet obtained by collecting the spun fiber into the form of 1 sheet in the step (a) may be continuously cross-lapped to form a mat-like material (sheet laminate) uniform thereacross in unit weight.

Step (d)

In the process of the present invention, the infusiblization and slight carbonization treatments may be arbitrarily done according to customary methods.

[1] Infusiblization Treatment

For example, the infusiblization treatment may be done through a heat treatment effected in an atmosphere of an oxidizing gas such as air, oxygen or $NO_x$ at a heat-up rate of 0.2° to 13° C./min, preferably 2° to 10° C./min, up to a temperature of 200° to 400° C.

[2] Carbonization Treatment

Where carbonization is followed by a physical entanglement treatment such as needle punching, a slight carbonization treatment is preferably effected. For example, carbonization is effected in an inert gas such as nitrogen gas at a heat-up rate of 5° to 100° C./min up to a temperature of 300° to 1,500° C., preferably 500° to 1,000° C., according to a customary method.

Step (3)

[1] Physical Entanglement Treatment

A necessary number of the resulting infusiblized and carbonized fiber sheets are piled up in accordance with the purpose and use thereof and subjected to a physical entanglement treatment such as needle punching, which usually has to be done at a density of 2 to 100 punches/cm$^2$.

Alternatively, the gas turbulence method, the columnar liquid stream penetration method, or the like may of course be employed.

According to any of these methods which can be carried out with a superior shape stability of felting material, however, a carbon fiber is sometimes oriented in the thickness-wise direction of a felting material being formed during the course of entanglement to lower the heat insulating effect of the felting material because the thermal conductivity of the felting material is higher in the direction of the carbon fiber. Thus, care should be taken to minimize such orientation of the carbon fiber.

In the case of needle punching, when the needle punch density was lower than 2 punches/cm$^2$, the resulting carbon fiber felting material is weakened in strength to unfavorably present a problem of poor handleability. When the needle punch density exceeds 100 punches/cm$^2$, the content of carbon fibers oriented in a direction perpendicular to the surface of a felting material being formed is increased to raise the thermal conductivity related to conductive heat transfer. This results in a unfavorable decrease in the heat insulating effect of the felting material. In addition, attendant fiber breakage unfavorably lowers the strength of the felting material.

[2] Chemical Entanglement Treatment a Impregnation with Binder

It is preferable that the mat-like material already subjected to the physical entanglement treatment such as needle punching (of course, the mat-like material may not be subjected to any physical entanglement treatment) be impregnated with a binder matrix capable of turning into a non-fibrous carbonized product upon carbonization, which is at least one substance selected from the group consisting of phenolic resins, furan resins, amino resins, tar and pitch, to effect such point-wise interfiber adhesion as to be able to keep the mat-like material in a desired morphology.

In this case, the amount of the inpregnating binder matrix may be minimum if only it is at least sufficient to retain the shape of felting material. The binder matrix content of the felting material is preferably in the range of about 5 to 40 wt. %.

b Curing of Binder

The impregnating binder matrix is subsequently cured, for example, by heating according to a customary method.

c Carbonization of Binder and the Like

Finally, the mat-like material thus treated is carbonized according to a customary method. For example, this can be done through a heat treatment in an inert gas such as nitrogen gas at a temperature of 900° to 2,000° C. for a given period of time.

Besides the foregoing kind of felting material simply comprising laminated sheets, the felting material of the present invention is able to have a considerably complicated shape because such a shape may be provided by interfiber adhesion with a resin or tar in the intermediate step (d).

(3) Binderless Entanglement Treatment

Without the use of a binder and without any physical entanglement treatment such as needle punching, entanglement may be effected through such a weak infusiblization treatment of a pitch fiber prior to carbonization as to effect incomplete infusiblization though the shape of the fiber is stabilized during the course of carbonization.

Suitable infusiblization conditions are preferably determined using the degree of oxygen inclusion of the infusiblized fiber as a yardstick. The term "degree of oxygen inclusion" used herein is intended to mean the percentage of the oxygen content of the infusiblized fiber relative to the oxygen content of the completely infusiblized fiber, the degree of oxygen inclusion of which is naturally 100%. Incomplete infusiblization is desirably effected up to a degree of oxygen inclusion of 30 to 95%, preferably 40 to 75%.

Specifically, the heat-up rate during the course of infusiblization may be set slow. For example, the temperature may be elevated to a predetermined infusiblization temperature of about 250° to 300° C. at a heat-up rate of about 1° to 3° C./min, followed by termination of heating before complete infusiblization. In this case, the resulting infusiblized fiber is in such an incompletely infusiblized state as to have self-bonding properties at the time of carbonization. The timing of termination of heating can be easily found by checking the oxygen content of the fiber. The oxygen ontent can be easily examined through elemental analysis of the infusiblized fiber to determine the degree of oxygen inclusion.

Heat transfer in a high temperature range wherein radiant heat transfer is dominant is considerably dissimilar from heat transfer in a low temperature range wherein convective heat transfer and conductive heat transfer are predominant.

The carbon fiber felting material of the present invention is so superior in the capability of absorbing as well as scattering a radiation contributory to radiant heat transfer that it is highly effective in heat insulation against radiant heat transfer.

A reason for the great heat-insulating effect against radiant heat transfer which the felting material of the present invention can exhibit is thin filaments used therein which have a small surface curvature radius. A smaller surface curvature radius provides the felting material with a larger capability of radiation scattering, which is believed to greatly contribute to heat insulation against radiant heat transfer.

The reason why a precursor pitch fiber produced by the melt blow method is especially excellent among various starting materials usable to produce the carbon fiber felting material of the present invention is general non-linearity of the fiber including many curls and crimps. Non-linear parts of the fiber provide such room for fiber movement as to reduce the chances of fiber breakage and increase the proportion of fibers inclined relative to the surface of the mat-like material at the sites of interfiber entanglement. This reduces through-fiber conductive heat transfer to provide an advantage of not spoiling the heat-insulating effect of the resulting felting material, which is otherwise in substantial proportion to the degree of entanglement.

BEST MODES FOR CARRING OUT THE INVENTION

The following Examples will now specifically illustrate the present invention, but should not be construed as limiting the scope of the invention.

Physical Entanglement

EXAMPLE 1

Petroleum pitch having a softening point of 284° C. and a mesophase content of 100% was used as a starting material to form a pitch fiber according to the melt blow method. The fiber was collected on a net conveyor to form a sheet.

The pitch fiber sheet was infusiblized by heating in air at a heat-up rate of 2.4° C./min to 300° C., and then slightly carbonized by heating in nitrogen gas at a heat-up rate of 5° C./min to 615° C.

The average filament diameter of the resulting slightly carbonized fiber was 6.5 μm, while the unit weight of the resulting sheet formed thereof was 28 g/m$^2$.

12 pieces of the sheet were piled up and subjected to needle punching. Felty materials produced at respective punch densities as listed in Table 1 were carbonized at a maximum temperature of 2,000° C.

The bulk density of the mat before punching was varied by the pressure applied thereto during slight carbonization to adjust the bulk density of the felting material after carbonization to 0.1±0.01 g/cm$^3$.

Additionally stated, a felty material produced at a punch density of 1.8 punches/cm$^2$ was not so good in coherence to show a tendency to exfoliate relatively easily into a number of sheets in the course of handling.

The moisture absorptions of all the felting materials produced in the foregoing manner were about 0.08%. The thermal conductivities of the felting materials as measured at 2,200° C. with a thermal conductivity measurement device for heat insulating materials (Model ITC25-VR11 manufactured by Ishikawajima-Harima Heavy Industries Co., Ltd. ) are listed together with punch densities in Table 1.

TABLE 1

| Run No. | 1 | 2 | 3 | 4 | 5 |
|---|---|---|---|---|---|
| Punch Density*1 | 1.8 | 7 | 35 | 95 | 100 |
| Thermal Conductivity*2 | 0.52 | 0.60 | 0.68 | 0.77 | 1.12 |

*1punches/cm$^2$
*2kcal/m · hr. · °C.

Runs Nos. 1 to 4 are of Example, while Run No. 5 is of Comparative Example.

EXAMPLE 2

The infusiblized sheets prepared in the same manner as in Example 1 were slightly carbonized under varied pressures applied thereto to obtain sheets having various bulk densities.

12 pieces of each kind of sheets having the same bulk density were subjected to needle punching at a density of 7 punches/cm$^2$ to produce a felting material.

The bulk densities of felting materials produced in the foregoing manner are listed in Table 2.

The thermal conductivities of the felting materials, measured at 2,200° C. in the same manner as in Example 1, are listed in Table 2.

TABLE 2

| Run Nos. | 1 | 2 | 3 | 4 | 5 |
|---|---|---|---|---|---|
| Bulk Density*1 | 0.008 | 0.02 | 0.08 | 0.45 | 0.59 |
| Thermal Conductivity*2 | 1.23 | 0.86 | 0.60 | 0.85 | 1.30 |

*1g/cm$^3$
*2kcal/m · hr · °C.

Runs Nos. 2 to 4 are of Example, while Runs Nos. 1 and 5 are of Comparative Example.

EXAMPLE 3

Isotropic coal pitch having a softening point of 238° C. as the starting material was spun and collected into the form of a sheet in the same manner as in Example 1, followed by infusiblization and slight carbonization thereof in the same manner as in Example 1 (average filament diameter after slight carbonization: 7 μm). The resulting sheets were piled up and subjected to needle punching in the same manner as in Example 1 to form a felting material.

The thermal conductivity of the felting material, measured at 2,200° C. in the same manner as in Example 1, was 0.92 kcal/m·hr·°C. The moisture absorption of the felting material was about 5 wt. %.

EXAMPLE 4

The same mesophase petroleum pitch as in Example 1 was spun and collected into the form of a sheet in substantially the same manner as in Example 1 except that the amount per orifice of pitch spun was varied to form fibers having different filament diameters. In substantially the same manner as in Example 1, each kind of pitch fiber sheet formed of fibers having the same average filament diameter was then infusiblized, slightly carbonized in a weakly compressed state, piled up, and subjected to needle punching at a density of 7 punches/cm$^2$ to form a felting material.

The average filament diameters of the fibers after slight carbonization thereof were listed in Table 3. The bulk densities of the felting materials were 0.1±0.01 g/cm$^3$. The thermal conductivities of the felting materials, measured at 2,200° C. in the same manner as in Example 1, are listed in Table 3. The moisture absorptions of the felting materials were 0.03 to 1.8 wt. %.

TABLE 3

| Run No. | 1 | 2 | 3 | 4 | 5 |
|---|---|---|---|---|---|
| Average Filament Diameter*1 | 1.2 | 3.6 | 8.7 | 11.0 | 16.0 |
| Thermal Conductivity*2 | 0.18 | 0.44 | 0.78 | 1.13 | 3.25 |

*1μm
*2kcal/m · hr · °C.

Runs Nos. 1 to 3 are of Example, while Runs Nos. 4 and 5 are of Comparative Example.

Entanglement with Binder

EXAMPLE 5

Petroleum pitch having a softening point of 284° C. and a mesophase content of 100% was used as the starting material to spin a pitch fiber according to the melt blow method. The pitch fiber was collected on a net conveyor to form a pitch fiber sheet having a unit weight of 30 g/m$^2$.

The sheet thus obtained continuously was piled up with a horizontal crosslapper to obtain a laminated sheet having a uniform unit weight of 600 g/m$^2$.

This laminated pitch fiber sheet was infusiblized by heating in air at a heat-up rate of 5° C./min up to 300° C., and subsequently slightly carbonized by heating in nitrogen gas at a heat-up rate of 5° C./min up to 615° C., followed by needle punching at a density of 13 punches/cm$^2$.

Two pieces of the resulting mats having a bulk density of 0.11 g/cm$^3$ were piled up and impregnated with a resol phenolic resin ("Plyophen" manufactured by Dainippon Ink & Chemicals, Inc. ) in such an amount as to provide a fiber content of 90 wt. %. The impregnated mats were heated at 165° C. to cure the resin. The resulting mat was carbonized at a maximum temperature of 2,000° C. to produce a felting material having a bulk density of 0.15 g/cm$^3$.

The average filament diameter of the fiber in the felting material was 6.5 μm. The thermal conductivity of the felting material, measured at 2,200° C. with a thermal conductivity measurement device for heat insulating materials (Model ITC25-VR11 manufactured by Ishikawajima-Harima Heavy Industries Co., Ltd. ), was 0.26 kcal/m·hr·°C.

EXAMPLE 6

The infusiblized sheets prepared in the same manner as in Example 5 were slightly carbonized under varied pressures applied thereto to obtain mats having various bulk densities, followed by needle punching at a density of 7 punches/cm$^2$.

Two pieces of each kind of the needle-punched mat were piled up and impregnated with the same resol phenolic resin as used in Example 5 in such an amount as to provide a fiber content of 90 wt. %. The impregnated mats were heated at 165° C. to cure the resin, and totally carbonized by heating up to 2,000° C. to produce a felting material (heat-insulating material).

The thermal conductivities of the resulting felting materials, measured in the same manner as in Example 5, are listed together with the bulk densities thereof in Table 4.

The average filament diameter of the fiber after carbonization was 6.5 μm.

TABLE 4

| Run No. | 1 | 2 | 3 | 4 | 5 |
|---|---|---|---|---|---|
| Bulk Density*1 | 0.02 | 0.09 | 0.2 | 0.41 | 0.57 |
| Thermal Conductivity*2 | 0.91 | 0.25 | 0.31 | 0.65 | 1.08 |

*1 g/cm³
*2 kcal/m · hr · °C.

Runs Nos. 1 to 4 are of Example, while Run No. 5 is Comparative Example.

EXAMPLE 7

Isotropic coal pitch having a softening point of 238° C. as the starting material was spun and collected into the form of a sheet in the same manner as in Example 5, followed by infusiblization and slight carbonization thereof in the same manner as in Example 5. The resulting mats were piled up and subjected to needle punching in the same manner as in Example 5 to form a felty material.

Two pieces of the resulting felty materials were piled up and impregnated with the same resol phenolic resin as used in Example 5 in such an amount as to provide a fiber content of 90 wt. %. The impregnated felty materials were heated to cure the resin and carbonized in the same manner as in Example 5. The thermal conductivity of the resulting felting material, measured in the same manner as in Example 5, was 0.60 kcal/m·hr·°C.

The average filament diameter of the fiber after carbonization was 7 μm.

EXAMPLE 8

The same mesophase petroleum pitch as in Example 5 was spun and collected into the form of a sheet in substantially the same manner as in Example 5 except that the amount per orifice of pitch spun was varied to form fibers having different filament diameters. The resulting fiber sheets were infusiblized and slightly carbonized in substantially the same manner as in Example 5. Two pieces of each type of the resulting sheet were piled up and subjected to needle punching at a density of 7 punches/cm² to form a felty material. The felty material was then impregnated with the same resol phenolic resin as used in Example 5, heated to cure the resin, and carbonized in the same manner as in Example 5 to produce a felting material having a bulk density of 0.1 g/cm³.

The average filament diameters and thermal conductivities of the felting materials (heat-insulating materials) thus produced, measured in the same manner as in Example 5, are shown in Table 5.

TABLE 5

| Run No. | 1 | 2 | 3 | 4 | 5 |
|---|---|---|---|---|---|
| Average Filament Diameter*1 | 1.2 | 3.6 | 8.7 | 11.0 | 16.0 |

TABLE 5-continued

| Run No. | 1 | 2 | 3 | 4 | 5 |
|---|---|---|---|---|---|
| Thermal Conductivity*2 | 0.17 | 0.23 | 0.42 | 1.06 | 1.25 |

*1 μm
*2 kcal/m · hr · °C.

Runs Nos. 1 to 3 are of Example, while Runs Nos. 4 and 5 are a Comparative Examples.

Binderless Entanglement

EXAMPLE 9

Petroleum pitch having a softening point of 284° C. and a mesophase content of 100% was used as the starting material to spin a pitch fiber according to the melt blow method. The fiber was collected on a net conveyor to form a pitch fiber sheet, which was then heated in air at a heat-up rate of 1° C./min up to 250° C. to be infusiblized.

The oxygen content of the resulting infusiblized fiber at this stage was determined to be 70% of the oxygen content of the completely infusiblized fiber.

12 pieces of the sheets thus obtained were piled up, heated under a pressure of 2 g/cm² up to 700° C. to effect slight carbonization thereof, and further heated up to a maximum temperature of 2,000° C. without pressure application to effect carbonization thereof to produce a felting material having a bulk density of 0.11 g/cm³.

The average filament diameter of the slightly carbonized fiber was 6.5 μm and the unit weight of the resulting sheet was 100 g/m².

The moisture absorption of the felting material was about 0.09%. The thermal conductivity of the felting material, measured at 2,200° C. with a thermal conductivity measurement device for heat insulating materials (Model ITC25-VR11 manufactured by Ishikawajima-Harima Heavy Industries Co., Ltd. ), was 0.52 kcal/m·hr·°C.

EXAMPLE 10

Felting materials having various bulk densities were produced in substantially the same manner as in Example 9 except that such infusiblization as to leave the infusiblized fiber sheets still self-bondable was effected by heating in air at a heat-up rate of 0.8° C./min up to 260° C. and the pressure applied to the piled-up infusiblized fiber sheets during slight carbonization thereof was varied.

The bulk densities of the felting materials are shown in Table 6. The thermal conductivities of the felting materials, measured in the same manner as in Example 9, are listed in Table 6.

TABLE 6

| Run No. | 1 | 2 | 3 | 4 | 5 |
|---|---|---|---|---|---|
| Bulk Density*1 | 0.009 | 0.03 | 0.07 | 0.46 | 0.47 |
| Thermal Conductivity*2 | 1.09 | 0.45 | 0.58 | 0.89 | 1.23 |

*1 g/cm³
*2 kcal/m · hr · °C.

Runs Nos. 2 to 4 are of Example, while Runs Nos. 1 and 5 are of Comparative Example.

EXAMPLE 11

Isotropic coal pitch having a softening point of 238° C. was used as the starting material to spin a pitch fiber by the melt blow method, and collected into the form of a sheet in substantially the same manner as in Example 9. The resulting pitch fiber sheet was heated in air at a heat-up rate of 1.2° C./min up to 240° C. to be so infusiblized as to be still self-bondable. The infusiblized sheets were piled up and slightly carbonized to produce a felting material (average filament diameter after slight carbonization: 7 μm).

The thermal conductivity of the felting material, measured in the same manner as in Example 9, was 0.92 kcal/m·hr·°C. The moisture absorption of the felting material was about 5.5 wt. %.

EXAMPLE 12

The same mesophase petroleum pitch as used in Example 9 was spun and collected into the form of a sheet in substantially the same manner as in Example 9 except that the amount per orifice of pitch spun was varied to form fibers having different average filament diameters. Each kind of resulting fiber sheet formed of fibers having the same average filament diameter were heated in air at a heat-up rate of 1.3° C./min up to 245° C. to be so infusiblized as to be still self-bondable, piled up, and slightly carbonized in a weakly compressed state to produce a felting material.

The average filament diameters of the slightly carbonized fibers are listed in Table 7. The bulk densities of the felting materials were 0.1±0.01 g/cm$^3$.

The thermal conductivities of the felting materials, measured in the same manner as in Example 9, are listed in Table 7. The moisture absorptions of the felting materials were 0.05 to 1.9 wt. %.

TABLE 7

| Run No. | 1 | 2 | 3 | 4 | 5 |
|---|---|---|---|---|---|
| Average Filament Diameter*1 | 1.3 | 3.4 | 8.6 | 11.2 | 16.4 |
| Thermal Conductivity*2 | 0.19 | 0.42 | 0.76 | 1.09 | 2.75 |

*1μm
*2kcal/m · hr · °C.

Runs Nos. 1 to 3 are of Example, while Runs Nos. 4 and 5 are of Comparative Example.

The carbon fiber felting material of the present invention is very stable in an inert atmosphere and exhibits excellent heat resistance and morphological stability within the temperature range of 500° to 2,800° C. as well as excellent heat insulating properties against radiant heat transfer.

The carbon fiber felting material of the present invention is so excellent in heat insulating properties in the high-temperature range that it can be used for heat insulation of high temperature furnaces which are used in fusion of glass, firing of pottery, smelting of metals, sintering of ceramics, or heat treatment of carbonaceous materials.

The carbon fiber felting material of the present invention is so excellent in stability against radiation that it can be used as a heat-insulating material with excellent performance in nuclear furnaces and nuclear power generating installations.

The heat-insulating, carbon fiber felting material of a mesophase pitch type in particular according to the present invention is so low in moisture absorption that the problems or troubles attributed to evaporation of water at the time of heat-up of a heat-insulating material and high-temperature water vapor can be avoided to favorably prevent deterioration of the carbon fiber felting material itself and to advantageously shorten the operation time of, for example, a furnace due to the ability of the heat-insulating material to allow for heat-up thereof in a short time without any troubles.

What is claimed is:

1. A melt-blown pitch type carbon fiber felting material excellent in heat insulating properties in a high-temperature range, which is substantially in the form of a felt formed of a pitch type carbon fiber through interfiber entanglement and having a bulk density of 0.01 to 0.5 g/cm$^3$, a thermal conductivity of at most 1.0 kcal/m·hr·°C. in the thickness-wise direction thereof at a temperature of 2,200° C., and an average filament diameter of 1 to 9 μm.

2. A carbon fiber felting matertial as claimed in claim 1, wherein said carbon fiber is of a mesophase pitch type, and which has a moisture absorption of at most 2 wt. % as measured in an atmosphere having a temperature of 200° C. and a relative humidity of 65%.

3. A process for producing a carbon fiber felting material excellent in heat insulating properties as claimed in claim 1: comprising the step (1) of spinning a starting pitch material by a melt blow method and collecting the spun fiber into the form of a sheet, the step (2) of subjecting the fiber sheet to infusiblization and subsequent slight carbonization treatments, and the step (3) of piling up a desired number of the resultant carbon fiber sheets and subsequently entangling said carbon fiber sheets with each other, followed by carbonization of the resultant mat if desired.

* * * * *